US009221061B2

(12) United States Patent
Rem et al.

(10) Patent No.: US 9,221,061 B2
(45) Date of Patent: Dec. 29, 2015

(54) EDDY CURRENT SEPARATION APPARATUS, SEPARATION MODULE, SEPARATION METHOD AND METHOD FOR ADJUSTING AN EDDY CURRENT SEPARATION APPARATUS

(75) Inventors: Peter Carlo Rem, Rijswijk (NL); Martinus Cornelis Maria Bakker, Delfgauw (NL); Simon Peter Maria Berkhout, Delft (NL); Mohammed Abdur Rahman, Delft (NL)

(73) Assignee: Inashco R&D B.V., Delft (NL)

( * ) Notice: Subject to any disclaimer, the term of this patent is extended or adjusted under 35 U.S.C. 154(b) by 56 days.

(21) Appl. No.: 14/001,833

(22) PCT Filed: Feb. 28, 2012

(86) PCT No.: PCT/NL2012/050118

§ 371 (c)(1),
(2), (4) Date: Jun. 29, 2014

(87) PCT Pub. No.: WO2012/118373

PCT Pub. Date: Sep. 7, 2012

(65) Prior Publication Data

US 2015/0108047 A1 Apr. 23, 2015

(30) Foreign Application Priority Data

Feb. 28, 2011 (NL) ..... 2006306

(51) Int. Cl.

| | |
|---|---|
| ***B03C 1/24*** | (2006.01) |
| ***B03C 1/30*** | (2006.01) |
| ***B03C 1/247*** | (2006.01) |

(52) U.S. Cl.

CPC . *B03C 1/30* (2013.01); *B03C 1/247* (2013.01); *B03C 2201/20* (2013.01); *B03C 2201/24* (2013.01)

(58) Field of Classification Search

CPC ..... B03C 1/23; B03C 1/24; B03C 1/247; B03C 1/30; B03C 2201/20; B03C 2201/24; G05B 13/00

See application file for complete search history.

(56) References Cited

U.S. PATENT DOCUMENTS

| | | | |
|---|---|---|---|
| 2,095,385 | A | 10/1937 | Heisserman |
| 2,662,641 | A | 12/1953 | Clark |

(Continued)

FOREIGN PATENT DOCUMENTS

| | | | |
|---|---|---|---|
| CN | 1895796 | A | 1/2007 |
| CN | 201482560 | U | 5/2010 |

(Continued)

OTHER PUBLICATIONS

Chinese Search Report dated Sep. 28, 2012, from CN 200980115792.4, with English translation.

(Continued)

*Primary Examiner* — Joseph C Rodriguez

(74) *Attorney, Agent, or Firm* — Swanson & Bratschun, L.L.C.

(57) ABSTRACT

Eddy current separation apparatus for separating particles from a particle stream. The eddy current separation apparatus comprises a separator drum adapted to create a first particle fraction and a second particle fraction, a feeding device upstream of the separator drum for supplying particles to the separator drum, and a splitter element provided downstream of the separator drum for splitting the respective fractions. The eddy current separation apparatus further comprises a sensor device arranged for detecting particles, and counting and/or detecting material properties of the detected particles, from at least part of one of the particle fractions. The eddy current separation apparatus is configured to adjust, in use, a position and/or orientation of the splitter element with respect to the separator drum and/or a transporting velocity of the feeding device in dependence of a signal from the sensor device based on a counted number and/or material properties of the detected particles.

16 Claims, 3 Drawing Sheets

(56) References Cited

U.S. PATENT DOCUMENTS

| | | | | |
|---|---|---|---|---|
| 2,772,776 | A | 12/1956 | Myron | |
| 3,356,213 | A | 12/1967 | Weber | |
| 3,430,870 | A * | 3/1969 | Weston | 241/34 |
| 3,757,946 | A | 9/1973 | Berkowitz | |
| 4,185,746 | A | 1/1980 | Fegan, Jr. | |
| 4,267,930 | A | 5/1981 | Melkonian | |
| 4,944,868 | A | 7/1990 | Jay | |
| 5,301,816 | A | 4/1994 | Weber | |
| 5,394,991 | A | 3/1995 | Kumagai | |
| 5,860,532 | A | 1/1999 | Arvidson | |
| 5,998,212 | A * | 12/1999 | Corio et al. | 436/63 |
| 6,068,133 | A | 5/2000 | Schonfeld | |
| 6,095,337 | A * | 8/2000 | Saveliev | 209/212 |
| 6,351,676 | B1 * | 2/2002 | Thomas | 700/28 |
| 6,541,725 | B2 | 4/2003 | Pearson | |
| 6,589,654 | B1 | 7/2003 | Arcaini | |
| 7,367,457 | B2 * | 5/2008 | Warlitz et al. | 209/225 |
| 7,726,493 | B2 | 6/2010 | Van Der Weijden | |
| 8,392,135 | B2 * | 3/2013 | McClain et al. | 702/81 |
| 8,459,466 | B2 * | 6/2013 | Duffy et al. | 209/630 |
| 8,678,194 | B2 * | 3/2014 | Rem et al. | 209/214 |
| 8,705,031 | B2 * | 4/2014 | Sedoglavich et al. | 356/337 |
| 8,807,344 | B2 * | 8/2014 | Keaton et al. | 209/223.2 |
| 8,919,566 | B2 * | 12/2014 | Golovanevskiy | 209/223.1 |
| 8,931,644 | B2 * | 1/2015 | Lean et al. | 209/726 |
| 9,016,478 | B2 * | 4/2015 | Bohnlein et al. | 209/214 |
| 2003/0000835 | A1 * | 1/2003 | Witt et al. | 204/451 |
| 2004/0040894 | A1 | 3/2004 | Warlitz | |
| 2006/0180522 | A1 | 8/2006 | Legtenberg | |
| 2007/0034554 | A1 | 2/2007 | Van Der Weijden | |
| 2013/0060509 | A1 * | 3/2013 | Tsunoda | 702/128 |
| 2013/0233776 | A1 | 9/2013 | Berkhout | |
| 2014/0238906 | A1 * | 8/2014 | Mohanty et al. | 209/571 |
| 2014/0309782 | A1 * | 10/2014 | Sharpe et al. | 700/266 |

FOREIGN PATENT DOCUMENTS

| | | | |
|---|---|---|---|
| DE | 2436864 | | 2/1976 |
| DE | 2928886 | | 1/1980 |
| DE | 4125236 | | 4/1992 |
| DE | 4223812 | | 8/1993 |
| DE | 4332743 | A1 | 4/1994 |
| DE | 9419448.3 | U1 | 2/1995 |
| DE | 19521415 | | 1/1997 |
| DE | 19649154 | | 3/1998 |
| DE | 19832828 | A1 | 1/2000 |
| DE | 19838170 | | 3/2000 |
| DE | 10056658 | | 7/2002 |
| DE | 102005054811 | | 1/2007 |
| EP | 0550867 | | 12/1992 |
| EP | 1676645 | | 7/2006 |
| ES | 2274434 | | 12/2005 |
| ES | 2352027 | | 2/2011 |
| FR | 2668961 | | 5/1992 |
| GB | 4684 | | 0/1909 |
| JP | S59-19576 | A | 2/1984 |
| JP | H07256231 | | 10/1995 |
| JP | 2000-70754 | | 3/2000 |
| JP | 2002-59083 | | 2/2002 |
| JP | 2003-170122 | | 6/2003 |
| JP | 2006-63152 | | 3/2006 |
| JP | 2007-116611 | | 5/2007 |
| JP | 2010-76178 | | 4/2010 |
| WO | WO 99/06151 | | 2/1999 |
| WO | WO 00/56472 | | 9/2000 |
| WO | WO 2004/082839 | | 9/2004 |
| WO | WO 2009/123452 | | 10/2009 |

OTHER PUBLICATIONS

International Search Report dated Aug. 15, 2011 from PCT/NL2011/050515.
International Search Report dated Jul. 3, 2009 from PCT/NL2009/050165.
International Preliminary Report on Patentability dated Aug. 23, 2010 from PCT/NL2009/050165.
Office Action dated Jan. 13, 2015, from U.S. Appl. No. 13/812,222.
Office Action dated Dec. 31, 2012, from U.S. Appl. No. 12/936,058.
Office Action dated Dec. 31, 2012, Response from U.S. Appl. No. 12/936,058.
Office Action dated Nov. 7, 2013, from U.S. Appl. No. 12/936,058.
Office Action dated Nov. 7, 2013, Response from U.S. Appl. No. 12/936,058.
Office Action dated Aug. 28, 2014, Final from U.S. Appl. No. 12/936,058.
Office Action dated Aug. 28, 2014, Final Response from U.S. Appl. No. 12/936,058.
Notice_of_Preliminary_Rejection_from_KR039889379_dated_Jun. 15, 2015_in_English.
Office Action dated Apr. 10, 2015, from U.S. Appl. No. 12/936,058.
Office Action dated Apr. 10, 2015, Response from U.S. Appl. No. 12/936,058.
Notice of Allowance dated Jun. 30, 2015, from Japanese App. No. 2013-556566, with English Translation.
Office Action dated May 25, 2015, from Chinese App. No. 2012800159125, with English Translation.
Office Action dated Sep. 21, 2015 from U.S. Appl. No. 14/696,230.

* cited by examiner

EDDY CURRENT SEPARATION APPARATUS, SEPARATION MODULE, SEPARATION METHOD AND METHOD FOR ADJUSTING AN EDDY CURRENT SEPARATION APPARATUS

RELATED APPLICATIONS

This application is a 35 U.S.C. §371 national phase application of PCT/NL2012/050118 (WO 2012/118373), filed on Feb. 28, 2012, entitled "Eddy Current Separation Apparatus, Separation Module, Separation Method and Method for Adjusting an Eddy Current Separation Apparatus", which application claims the benefit of NL Application Serial No. 2006306, filed Feb. 28, 2011, each of which is incorporated herein by reference in its entirety.

FIELD AND BACKGROUND OF THE INVENTION

The present invention relates to eddy current separation technology. More in particular, the present invention relates to an eddy current separation apparatus for separating particles from a particle stream, wherein the separation apparatus comprises a separator drum adapted to create out of the particle stream at least a first particle fraction moving from the drum along a first trajectory and a second particle fraction moving from the drum along a second trajectory, a feeding device upstream of the separator drum for supplying particles to said separator drum, and a splitter element provided downstream of the separator drum for splitting the first particle fraction from the second particle fraction.

Eddy current separation technology is commonly known for sorting and separating metal particles from a stream of particles. By using an eddy current separation apparatus, recovering metals such as aluminium from household, industrial and incinerated waste, including inert plastics and other materials is possible. Eddy current separation technology provides for a relatively cost effective method of recovering a large part of valuable material from rubbish and waste.

Such a known eddy current separation apparatus usually comprises a conveyor to transport the stream of waste particles towards a rotating drum comprised of magnet blocks. The drum is adapted to spin with a high rotational speed, i.e. a speed higher than the transporting velocity of the conveyor, such that it produces an eddy current in the metal particles. The eddy current interacts with different metals according to their specific mass and resistivity such that a repelling force on the particle is created. If a metal is light and conductive, for instance aluminium, the particle is lifted up and ejected from the normal flow of the particle stream along a first trajectory. These ejected particles may then be separated from the non-metal particles that continue travelling along the conveyor and fall over the drum separating them from the ejected metal particles. The drum provides in combination with a conveyor transporting velocity the means for separation. The splitter element, provided downstream of the drum, guides the two separate fractions of particles moving along respective trajectories towards respective receptacles that collect the particles of the respective fractions.

When using the eddy current separator to separate metal particles from a waste stream, the splitter element is positioned and/or orientated with respect to the drum by the operator of the separator. The composition of the waste stream causes the particles to travel along a certain particle trajectory. Consequently, after observing said particle trajectory visually and also based on the intuition of the operator, the operator may determine the best position and/or orientation for the splitter element and adjust the element accordingly. In case the particles to be separated have a relatively small diameter, the different particles are more difficult to separate and the respective trajectories of the different particle fractions are closely spaced or even partly overlap. Consequently, determining the appropriate location for the splitter element based on visual observation and intuition will be difficult.

Therefore, it is an object of the present invention to provide for an improved eddy current separation apparatus. More in particular an object of the invention is to provide an eddy current separation apparatus that enables separation of particles from a waste stream in an efficient manner even if the particles to be separated have a minimal diameter.

SUMMARY OF THE INVENTION

According to one aspect of the invention an eddy current separation apparatus for separating particles from a particle stream of the above type is provided. The separation apparatus is characterized in that it further comprises a sensor device arranged to detect particles, at least a number and/or material properties thereof, from at least part of one of the particle fractions, wherein the separation apparatus is configured to adjust, in use, a position and/or orientation of the splitter element with respect to the separator drum and/or a transporting velocity of the feeding device in dependence of a signal from the sensor device based on the number and/or the material properties of the detected particles, for instance based on a counted number of particles passing through the sensor device.

By automatically adjusting the position and/or orientation of the splitter element based on objective sensor measurements, the optimal position and/or orientation of the splitter element with respect to the separator drum may be determined for the specific waste stream. Preferably, the splitter element may be movably mounted to the apparatus such that a distance between the splitter element and the separator drum and/or an orientation of the splitter element with respect to the separator drum is adjustable in dependence of said signal from the sensor device. The sensor device may be adapted to count the number of different types of particles passing the sensor device and based on the gathered data determine a specific splitter element position. The operator may adjust the position or the position of the splitter element may be adjusted automatically, preferably in real-time. For instance, a waste stream may be subjected to changes of the moisture content thereof. In case the feeding rate of the waste stream remains constant, upon a change of moisture content thereof the first trajectory followed by the first particle fraction changes relatively to the second trajectory followed by the second particle fraction. For instance, if the waste stream becomes moister, the number of particles of the first particle fraction that is detected near the current splitter element position changes. In that case, the position of the splitter element may be adjusted such that the number of particles of the first particle fraction remains substantially constant. Instead of or additionally to the adjustment of the position and/or orientation of the splitter element, the transporting velocity of the feeding device may be adjusted. In case the number of counted particles does not comply with the predetermined value, the transporting velocity of the feeding device may be increased or decreased. Upon increasing the velocity, the particles will travel a larger distance from the separator drum and in case the velocity is decreased, the particles will end up at a shorter distance from the separator drum. Due to such a construction of the eddy current separation apparatus, the separation of the respective fractions may be conducted in an efficient and objective manner enabling efficient separation of waste streams containing relatively small particles, for instance with an average diameter that is smaller than 15 mm or even smaller than 10 mm, for instance between 1-10 mm. Due to the fact that a particle stream, for instance a waste stream, such as a bottom ash waste stream, may be substantially composed of a substantially single colour, such as substantially grey, or of a colour range with substantially alike colours, the different particles comprises in said waste stream are not identifiable only by means of the appearance thereof. Therefore, accurate separation of the respective particle fractions from the bottom ash waste stream based on visual detection by means of a camera, such as a black and white camera, colour camera, infrared camera, and the like cameras, can not be obtained. The sensor device according to the invention is configured to detect the different kinds of particles despite of the appearance such as the colour or colour range of the different particles of the particle stream and also irrespective of the particles being covered by dust.

Consequently, the purity of the separated particle fraction may increase thereby, in case of separating metal particles, increasing the value of the recovered separated particle fractions.

Furthermore, due to the fact that the position of the splitter element is based on said objective sensor measurements of the number of particles passing the sensor device and due to the subsequent automatic adjustment of the location of the splitter element, the optimal position of the splitter element is obtained in real time, thus enhancing continuous accuracy of the separation operation. Besides, the investments to be made for providing the improved eddy current separation apparatus are relatively low with respect to the improved quality of the particle fractions that may be recovered with said improved separation apparatus.

Preferably, the eddy current separation apparatus is configured to adjust the position of the splitter element substantially continuously, for instance every few seconds, such as ten seconds, based on the signal from the sensor device. Adjusting the splitter element position typically every ten seconds suffices when separating separate particle fractions from a bottom ash waste stream. In such kind of waste stream, the composition of the material may not vary any faster than every few seconds. Therefore, adjusting the position of the splitter element every few seconds is in conformity with said kind of particle stream to be separated. It may be that the time between successive adjustments of the splitter element may be different, i.e. longer or shorter, when separation of another kind of particle stream is demanded.

According to a further aspect of the invention, the sensor device preferably comprises a first sensor part being a transmitter sensor part, such as an optical emitter or an acoustic transmitter, adapted to transmit energy in substantially a beam shape, and a second sensor part, being a receiver sensor part, such as an optical receiver or an acoustic receiver. Also other kinds of sensor devices may be used to advantage, for instance based on micro-radiation, electromagnetic radiation such as infrared radiation and other suitable sensor devices that are configured to emit beam shaped energy and causes measurable reflection and/or attenuation when a particle passes the energy beam. The sensor device may be configured to count the particles passing the beam as energy per unit of time, and to measure the size of the respective particles and/or the angular velocity of the respective particles.

The respective particle fractions may comprise one of a ferrous particle fraction, a non-ferrous metal particle fraction and a non-metal particle fraction. The eddy current separation apparatus may be configured to separate two or more particle fractions from the stream of particles. The separator drum may comprise a permanent magnet or an electromagnet. The latter may be configured to be switched on and off during the separation process in case one of the separate particle fractions is a ferrous metal particle fraction.

To be able to more accurately determine the quality of the separated particle fraction of the particle stream, said particle fraction being a metal particle fraction, it may be advantageous to provide the sensor device with a third sensor part, such as an electric coil, that is configured to detect an electromagnetic response of conductive particles passing said third sensor part. In further elaboration of the invention, the third sensor part may comprise at least two electric coils. At least one for generating the magnetic field and at least one for detection of the metal particles passing said third sensor part. Such an electric transmitter coil generates an electro-magnetic field, but does not emit net energy, thus also not a beam of energy, in absence of particles.

Eddy current separation is, in general, imperfect. This means that the first particle fraction, for instance a metal particle fraction, always contains particles of the second particle fraction, for instance non-metal particles such as plastic particles, next to the first particles. By determining the number of particles of the separated metal fraction over a period time and the number of actual metal particles contained in said fraction, the distance between the separator drum and the splitter element may be determined more accurately. For instance, in case the number of metal particles with respect to the number of non-metal particles increases, it may be desirable to move the splitter element towards the separator drum. On the other hand, if the number of metal particles with respect to the number of non-metal particles decreases, the splitter element may be moved away from the separator drum. Additionally to or instead of moving the splitter element, the conveying velocity of the feeding device, such as a conveyor, may be adjusted by increasing or decreasing the velocity. After all, when increasing the velocity of the conveyor, the particles that are ejected by means of the separator drum will travel a different trajectory and may end up at a larger distance from the separator drum than with a lower conveyor velocity.

It is noted that the optimal position of the splitter element depends on the settings of the eddy current separation unit, for instance velocity of the conveyor and the rotational speed of the separator drum.

In further elaboration of the invention, the sensor device comprises a detection section configured to allow to pass a sample (i.e. a small percentage) of the first particle fraction, wherein the sensor device is configured to calculate a metal grade of the first particle fraction based on the sensor counts and a given average particle mass ratio between non-metal and metal particles. The sample size of such sensor device may be maximally 20 parts per second. The metal grade (concentration of metal particles) of a representative number of particles (sample size) from the waste particles stream may be calculated from the sensor counts and the given average particle mass ratio k between non-metal and metal particles. The metal grade of the waste stream is from here on denoted as G, while m is the average particle mass and $N^{IRS}$, $N^{EMS}$ are the sensor counts. $N^{IRS}$ is the sensor count of the first and second sensor parts, and represents the total amount of particles passing said sensor parts. $N^{EMS}$ is the sensor count of the third sensor part, and represents the amount of metal particles passing said sensor part. A count correction factor is introduced for the respective sensor parts in view of the chance that it misses some particles, mainly due to particles falling simultaneously through the sensor device. The metal grade may now be related to the hybrid sensor measurements as follows:

$$G = \frac{N^{EMS} C^{EMS} m^{metal}}{(N^{IRS} C^{IRS} - N^{EMS} C^{EMS}) m^{non-metal} + N^{EMS} C^{EMS} m^{metal}} = \frac{Z}{(C - Z)k + Z}. \quad (1)$$

The Z (0<Z<1) denotes the ratio of sensor counts, C the ratio of sensor count correction factors and k the ratio of average particle masses, according to:

$$Z = N^{EMS}/N^{IRS}, k = m^{non\text{-}metal}/m^{metal}, C = C^{IRS}/C^{EMS}. \quad (2)$$

The correction factors and k can be determined in a calibration test using particle mixtures of known composition (known grade).

With a sensor device comprising the first and second sensor parts as well as the third sensor part a very accurate separation of non-ferrous metal particles from a particle stream, such as a bottom ash waste stream, may be obtained. Even particles with an average diameter of 1-10 mm can be separated effectively. A typical eddy current separation apparatus is configured for accurately separating particles with an average diameter of approximately 10 mm and more. Consequently, with the eddy current separation device according to the invention, an improved separation is possible even for waste streams with particles have a substantially similar colour or hue. Since a sample of the particle fraction is detected, scattering of particle fraction is not of a substantial influence to the accuracy of separation by means of the sensor device according to the invention. In contrary to separation based on for instance a camera. In that case, scattering of the particle stream results in less accurate particle counts since not every particle may be detected by a camera. Consequently, separation of particles by means of the sensor device of the invention is very effective.

It is noted that such a sensor device can also be used to advantage for monitoring quality.

Preferably, the sensor device is arranged at a side of the splitter element facing away from the separator drum. For instance, the first, second and third sensor part may be provided in a housing, which may be coupled to the splitter element for effective sampling of the first particle stream.

To be able to split the respective separated particle fractions, the separation apparatus may comprise, in further elaboration of the invention, a control unit operatively connected to the sensor device, the particle feeding device and/or the splitter element, wherein the control unit is configured to control at least one of a feeding device velocity, such as conveyor velocity, displacement and/or orientation of the splitter element with respect to the separator drum.

It may be advantageous, according to a further aspect of the invention, if the control unit comprises a memory to store a predetermined relation between at least a number of detected particles and the splitter element position and/or the feeding device velocity. The control unit may then enable relocation of the splitter element easily in case the number of detected particles changes during operation of the eddy current separation apparatus. Dependent on the measured data, the distance between the separator drum and the splitter element and/or the optimal velocity of the feeding device may be known from the stored relation. Consequently, the new position of the splitter element results automatically when the number of particles passing the sensor device is known. Such a system provides real time adjustment of the splitter element during operation of the separation apparatus.

According to another aspect of the invention, the separation apparatus may comprise a frame that slidably receives the splitter element, for instance by means of a guide provided on the frame. This results in a simple construction of the movable splitter element and provides for easy displacement of said element to and from the separator drum. In further elaboration of the invention, the separation apparatus may comprise a frame that rotatably receives the splitter element, for instance further comprising a motor operatively coupled to the splitter element such that said splitter element can be rotated by a rotating axis of said motor. This results in a simple construction of the rotatable splitter element and provides for easy rotation of said element with respect to the separator drum.

It is noted that the splitter element throughout this application should be interpreted in a broad way. For instance the splitter element may be a separate part that is provided on a frame, movably and/or rotatably as above described. Instead, the splitter element may comprise a wall of a container or receptacle provided downstream the particle trajectories. Said container or receptacle may be displaceably provided with respect to the separator drum to enable adjustment of the splitter element position.

In further elaboration of the invention, the separation apparatus may contain more than one splitter element. The respective splitter elements may be provided at mutual distance such that more than two particle fractions may be separated from the particle stream. The respective splitter elements may be controlled simultaneously or independently. In the latter case, more than one sensor device may be provided, each device operatively coupled to the control unit to control the respective splitter elements based on signals from the respective sensor devices.

The sensor device may have different configurations and be provided in different manners with respect to the splitter element to accurately determine the number of particles passing. For instance, the transmitter part of the sensor device may be arranged such that in use the transmitted energy travels towards the splitter element surface in a direction substantially perpendicular to said splitter element surface. Alternatively, the transmitter part of the sensor device may be arranged such that in use the transmitted energy travels substantially parallel to the splitter element surface and thus substantially parallel to a central axis of the separator drum.

Furthermore, in either configuration of the transmitter part, the receiver part of the sensor device may be arranged at a distance from the splitter element surface. Alternatively, the receiver part of the sensor device may be arranged such that in use the transmitted energy is received from a direction substantially parallel to a plane extending through the splitter element surface.

To protect the sensor device from fouling, the sensor device may be at least partly surrounded by a cover. According to a further aspect of the invention, the cover may comprise at least one sheet shaped element, wherein the sheet shaped element is provided at an angle with respect to a displacement direction of the metal particle fraction.

The invention further relates to a separating module for use with an eddy current separation apparatus, such as a known eddy current separation apparatus as described before. According to the invention, the separating module at least comprises the above described splitter element, the sensor device and the control unit. The invention also relates to a method for modifying an eddy current separation apparatus into an eddy current separation apparatus according to the invention. The method comprises providing an eddy current separation apparatus and providing the above described separating module. After removing of the splitter element from the eddy current separation apparatus, the separating module may be mounted to the separation apparatus. Then, the control unit may be operatively connected to the feeding device of the separation apparatus such that besides adjusting the location of the splitter element based on signals from the sensor device, also the transporting velocity of the feeding device may be adjusted. By providing such a separating module and such a method for adapting an eddy current separation apparatus, known eddy current separation apparatuses may be easily adjusted into improved separation apparatuses according to the invention thereby providing similar effects and advantages as described before.

Furthermore, the invention relates to a method for separating particles from a stream of particles, preferably by using the above described an eddy current separating apparatus according to the invention, wherein the method comprises:

- supplying a particle stream to the separator drum;
- detecting a number of particles of at least part of one of the particle fractions coming from the drum;
- counting said number of particles;
- displacing the splitter element based on the particle count to adjust the distance and/or orientation of the splitter element with respect to an outer circumference of the drum and/or adjusting the transporting velocity of the feeding device based on the counted number of particles.

Such a method provides similar effects and advantages as described with the eddy current separation apparatus according to the invention.

The aforementioned and other features and advantages of the invention will be more fully understood from the following detailed description of certain embodiments of the invention, taken together with the accompanying drawings, which are meant to illustrate and not to limit the invention.

BRIEF DESCRIPTION OF THE DRAWINGS

It is noted that identical or corresponding elements in the different drawings are indicated with identical or corresponding reference numerals.

DETAILED DESCRIPTION

Figure 1:
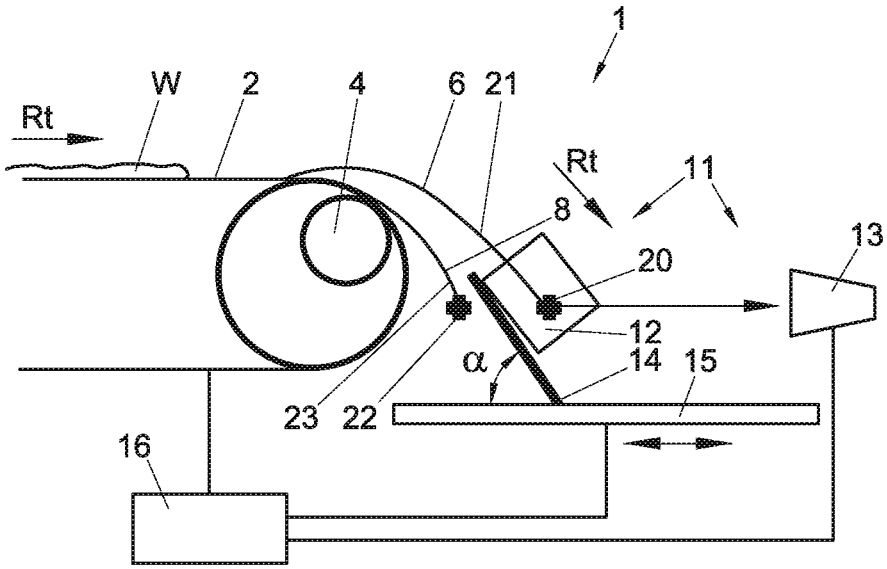
FIG. 1 shows a schematic side view of an eddy current separation apparatus according to a first embodiment of the invention.
Figure 2:
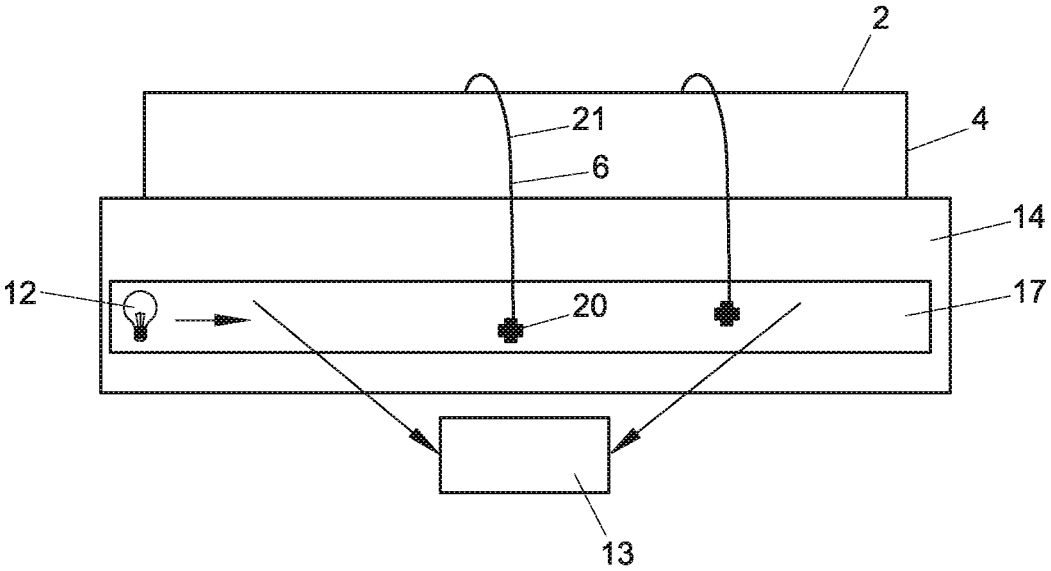
FIG. 2 shows a schematic front view of the apparatus shown in FIG. 1.

In FIGS. 1 and 2, a first example of the eddy current separation apparatus 1 according to the invention is shown. The eddy current separation apparatus 1 is adapted for separating non-ferrous metal particles 20, such as aluminium, copper, zinc and brass particles, from a waste stream W. Therefore, the eddy current separation apparatus 1 comprises a conveyor 2 for supplying a particle stream of waste material W to a separator drum 4 in a transporting direction Rt. The separator drum 4 comprises a rotatable permanent magnetic drum and is adapted to induce electric currents, i.e. eddy currents, within the volume of each particle 20, 22 flowing in the proximity of the drum 4. The influence of the magnetic field on the induced currents results in a Lorenz force which ejects the particles 20 out of the magnetic field of the drum 4 resulting in a first non-ferrous particle fraction 21 travelling along a first trajectory 6. The remainder of the particle stream, thus the part that is not ejected out of the magnetic field of the drum 4 by means of the generated eddy current, i.e. the non-metal or non-conductive particle fraction 23, travels along a second trajectory 8 remote from the first trajectory 6.

The separation apparatus 1 further comprises a splitter element 14 that is provided downstream of the separator drum 4 to provide a partition between the non-ferrous metal particle fraction 21 of the particle stream and the non-conductive fraction 23 of the particle stream. Both particle fractions 21, 23 may be collected independently, for instance in a respective container (not shown) provided on both sides of the splitter element 14.

It is noted that "downstream" and "upstream" are defined in relation to the transporting direction Rt of the particles 20, 22.

The splitter element 14 may be arranged displaceably along a guide 15 that is provided in the separation apparatus 1. The guide may be mounted on a frame (not shown) that may be connected to a base (not shown) supporting the conveyor 2 and the separator drum 4 or may be a separate frame provided next to the base. Also other suitable configurations may be possible. The splitter element 14 may further be arranged such that an orientation thereof with respect to the separator drum 4 may be altered. In different words, the angle $\alpha$ enclosed by the splitter element 14 and a plane substantially parallel to the transporting direction Rt of the conveyor 2, may be varied such that the orientation of the splitter element 14 is adjusted to the trajectory 6, 8 of the respective particle fractions 21, 23. The displacement of the splitter element 14 and/or the altering of the orientation of the splitter element 14 may be induced by means of a signal from the sensor device 11 provided in the separation apparatus 1.

The sensor device 11 is adapted to detect a number of particles, in the shown embodiment a number of particles 20 of the non-ferrous particle fraction passing the device 11 during a certain time period. The sensor device 11 may also be configured to determine the size of the particle 20, or whether the particle 20 is a non-ferrous metal based on deduction from oscillations of the sensor signal. Preferably, the sensor device 11 is adapted to measure reflection and attenuation when a particle 20 passes the light beam 17. The sensor device 11 is provided at a side of the splitter element 14 facing away from the separator drum 4. According to the first example of the separation device 1 according to the invention, the sensor device comprises a light emitting sensor part 12 and a light receiving sensor part 13 that cooperate to determine the number of particles passing by. The light emitting sensor part 12 is arranged such that the light beam 17 emitted by the sensor part 12 travels in a direction substantially parallel to the splitter element 14. The light receiving sensor part 13 is provided substantially orthogonal with respect to the splitter element 14 and detects the particles 20 passing through the beam of light.

The separation apparatus 1 comprises a control unit 16 that is operatively coupled to the sensor device 11, the splitter element 14 and the conveyor 2. The control unit 16 comprises a memory in which a predetermined relation between a number of particles 20 passing the sensor device 11 in a certain time span and a position and/or orientation of the splitter element 14 with respect to the separator drum 4 is stored. In case a certain number of particles 20 is detected, the control unit 16 may control the splitter element 14 to adjust the distance d to the separator drum 4 and/or the orientation with respect to a plane substantially parallel to the transporting direction Rt of the conveyor 2. Based on the measurements, the splitter element 14 may be positioned optimally for the kind of particle stream W to be separated, thereby enhancing the grade and recovery of the non-ferrous particles 20 from the waste stream W. For instance, in case the determined number of particles is less than a pre-determined threshold, the distance d between the splitter element 14 and the separator drum 4 may be decreased. At the same time, the inclination of the splitter element 14, thus angle α, may be increased. In case the number of particles exceeds the pre-determined threshold, the splitter element 14 may be moved away from the separator drum 4 and the inclination may be decreased.

The control unit 16 may further control the conveyer velocity to influence the particle trajectories 6, 8 of the separate particle fractions of the waste stream W to further increase the grade and recovery of the non-ferrous material. The apparatus 1 may further comprise a belt weighing device (not shown) to determine the feed rate of the eddy current separation device. Instead an ultrasound sensor device (not shown) may be provided to determine the feed rate by means of the height of the waste stream W. The control unit 16 may also be configured to control the position of the splitter element 14 and/or the velocity of the conveyor 2 based on data gathered by device to determine the feed rate.

According to a further (not shown) example of the eddy current separation apparatus, the separator drum may be an electromagnetic separator drum. With such a drum, that may be switched on and off during the separation process, for instance multiple times per second, the eddy current separator may also separate ferrous metal particles from the stream of particles, next to non-ferrous particles and non-metal (i.e. non conductive) particles. During the separation process, the ferrous metal particles will stick to the separator drum longer than the other kind of particles from the waste stream. Due to the intermittent separator drum, the ferrous metal particles may in the end be released from the separator drum and will end up in a container substantially below the separator drum. The non-metal particles move along the second trajectory, and the non-ferrous particles move along the first trajectory, ending up in the container most remote from the separator drum.

Figure 3:
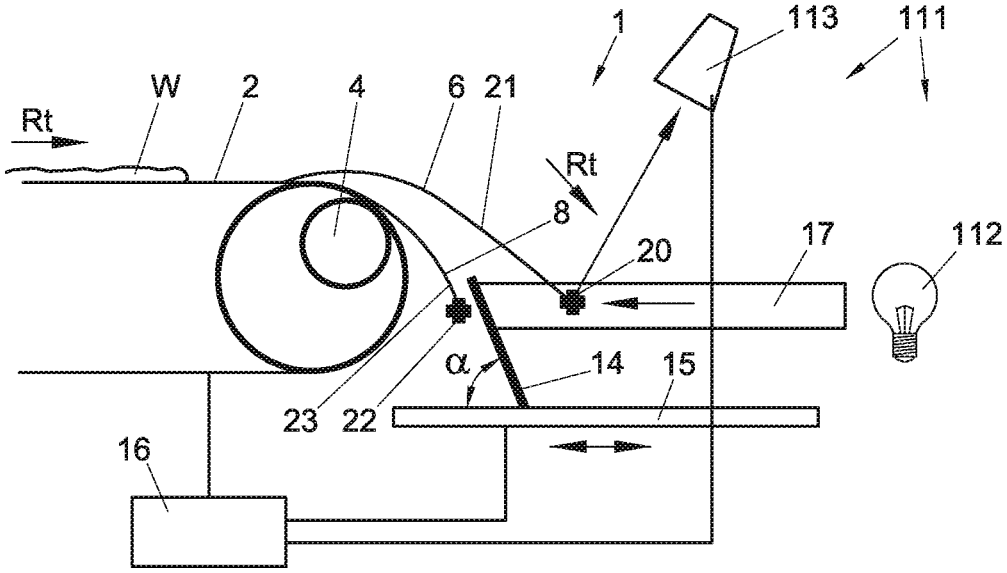
FIG. 3 shows a schematic side view of an eddy current separation apparatus according to a second embodiment of the invention.
Figure 4:
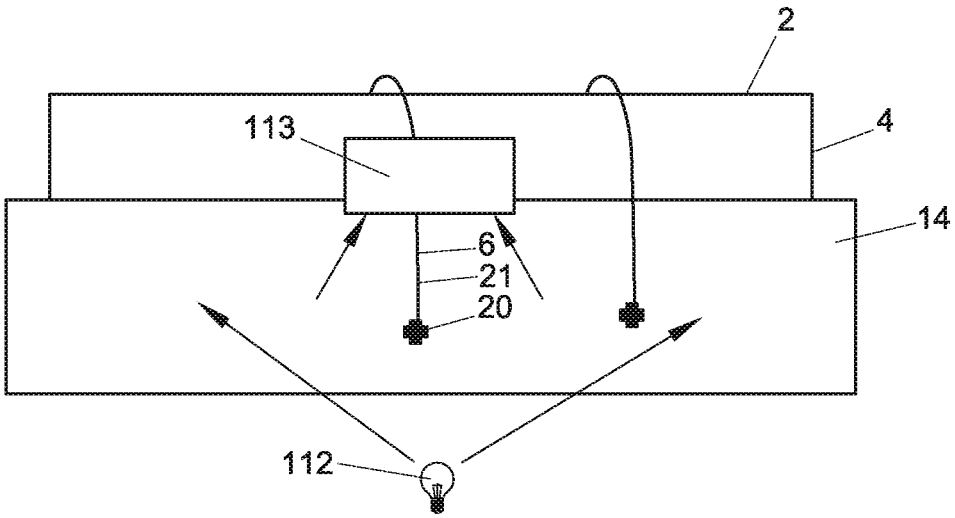
FIG. 4 shows a schematic front view of the apparatus shown in FIG. 3.

In FIGS. 3 and 4 a second example of the eddy current separation apparatus 1 according to the invention is shown. For the sake of clarity, only the elements that differ from the first example will be described in detail. For the description of the other similar parts, reference is made to the description of FIGS. 1 and 2.

The difference between the eddy current separation apparatus 1 according to the first example and the eddy current separation apparatus 1 according to the example shown in FIGS. 3 and 4 lies in the different configuration of the sensor device 111. The light emitting sensor part 112 of this device 111 is arranged such that, in use, the light beam 17 travels towards the splitter element 14 in a direction substantially opposite to the transporting direction Rt. The light receiving sensor part 113 is provided such that the light beam 17 travels in a direction substantially orthogonal from the splitter element 14. Operation of the eddy current separation apparatus 1 according to the second example corresponds to the operation of the apparatus 1 according to the first example of the invention.

Figure 5:
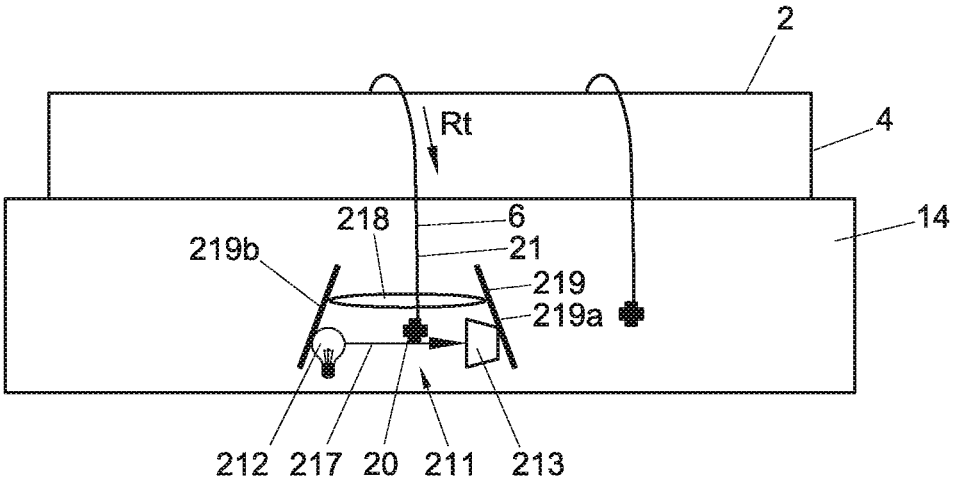
FIG. 5 shows a schematic front view of an eddy current separation apparatus according to a third embodiment of the invention.
Figure 6:
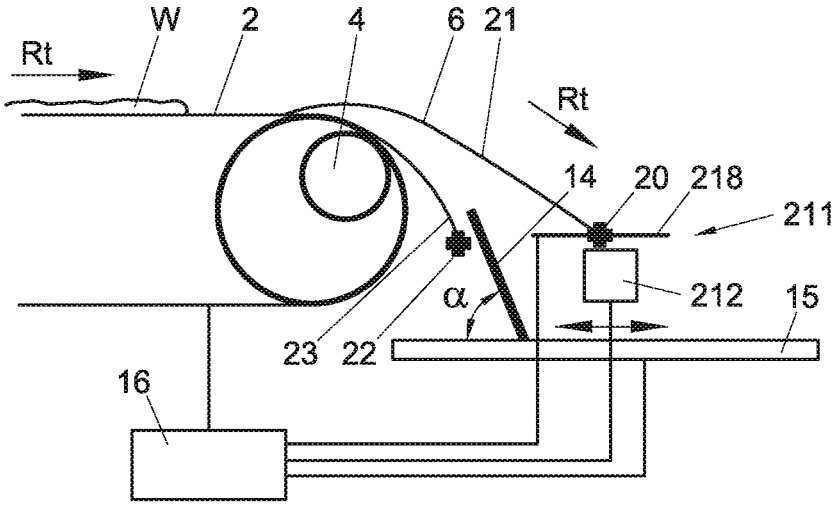
FIG. 6 shows a schematic side view of the apparatus shown in FIG. 5.

In FIGS. 5 and 6 a further example of the separation apparatus 1 according to the invention is shown. For the sake of clarity, only the elements that differ from the first and second example will be described in detail. For the description of the other similar parts, reference is made to the description of FIGS. 1 and 2.

The difference between the third example of the eddy current separation apparatus 1 with respect to the first and the second example is that the sensor device 211 additionally comprises an electric coil 218 or any other suitable electromechanical sensor, that is adapted to detect an electromagnetic response of the particles 20 passing said coil 218. Due to this coil 218, the sensor device 211 is able to count the number of metal particles, in this case non-ferrous metal particles, besides the total number of particles 20 passing through the sensor device 211. The sensor device 211 according to the third embodiment of the invention may comprise a detection section configured to allow passing a sample (i.e. a small percentage) of the first particle fraction 6. The sensor device 211 is configured to calculate a metal grade (i.e. concentration of metal particles) of the first particle fraction based on the sensor count of the first and second sensor parts 212, 213 and on the sensor count of the third sensor part 218 and a given average particle mass ratio between non-metal and metal particles. Calculation of the metal grade may be obtained using Equations (1) and (2) as described in the summary of the invention.

In case the ratio between the number of metal particles and the total number of particles 20 in the metal particle fraction 21 is below a pre-determined threshold or decreases during the separating operation, the splitter element 14 may be positioned too close to the separator drum 4. The control unit 16 may then control the splitter element 14 to displace to a location more remote from the separator drum 4. In case said ratio is above a certain pre-determined threshold or increases during the separation operation, the distance d between the splitter element 14 and the separator drum 4 may be too large. The distance d may be altered until the ratio may be optimal for recovering the majority of the metal particles from the waste particle stream. In the third example shown in FIGS. 5 and 6, the light emitting sensor part 212 may be configured similarly as the light emitting sensor part 12 of the first example. However, the light receiving sensor part 213 may be positioned at a distance of the light emitting sensor part 212, wherein both sensor parts 212, 213 are located at a similar distance from the splitter element 14. Thus, the emitted light beam 217 travels along a path substantially parallel to the surface of the splitter element before reaching the light receiving sensor part 213.

As is visible in FIG. 5, the sensor device 211 is at least partly surrounded by a cover 219. In the shown example, the cover 219 comprises two sheet shaped panels 219*a,b*, for instance of a metal or other suitable material, that fan out seen in the transporting direction Rt of the particles. These panels 219 *a, b* protect the sensor device 211 from getting dirty and/or damaged and thus reduce the risk of sensor device failure. Preferably, the cover 219 has such a shape and dimensions that cleaning thereof is easy and does not interrupt the separation process unnecessarily.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. It will be clear, for example, that the eddy current separation apparatus may comprise a sensor device according to the invention that is operatively coupled to the feeding device only and is configured to generate a signal to control the feeding device velocity. In such an example, the splitter element does not necessarily have to be relocated. Furthermore, it may be clear that the emitting sensor part and the receiving sensor part may be of different kinds and be part of different configurations than the ones that are described with the different examples of the eddy current separation apparatus 1 according to the invention. The electric coil may be used with any kind of first and second sensor parts as long as these parts cooperate to count the total number of particles passing said sensor parts. Also other kinds of third sensor parts that are able to count the number of conductive sensor parts passing said third sensor part may be used to advantage. The third sensor part may also be configured to determine the kind of metal particles passing said sensor part.

Furthermore, the splitter element 14 may be of different designs and comprises different means to provide the displaceability of the splitter element 14 with respect to the separator drum 4.

Two or more particle fractions may be separated by means of the eddy current separation apparatus according to the invention. The number of splitter elements to be used may then correspond to the number of particle fractions to be separated. Depending on the kind of particles to be separated, the separator drum may comprise a permanent magnet or an electromagnet.

Reference throughout this specification to "one embodiment" or "an embodiment" means that a particular feature, structure or characteristic described in connection with the embodiment is included in at least one embodiment in the present invention. Thus, the appearances of the phrases "in one embodiment" or "in an embodiment" in various places throughout this specification are not necessarily all referring to the same embodiment. Furthermore, it is noted that particular features, structures or characteristics of one or more embodiments may be combined in any suitable manner to form new, not explicitly described embodiments.

The invention claimed is:

1. An eddy current separation apparatus for separating particles from a particle stream, the eddy current separation apparatus comprising:

a separator drum adapted to create out of the particle stream at least a first particle fraction moving from the separator drum along a first trajectory and a second particle fraction moving from the separator drum along a second trajectory;

a feeding device upstream of the separator drum for supplying particles to said separator drum;

a splitter element provided downstream of the separator drum for splitting the first particle fraction from the second particle fraction; and a sensor device arranged for detecting particles and arranged for at least one of counting the detected particles to determine a counted number of detected particles or detecting material properties of the detected particles from at least part of one of the particle fractions, wherein said splitter element is movably mounted to the eddy current separation apparatus such that at least one of a distance between the splitter element and the separator drum, an orientation of the splitter element with respect to the separator drum or a transporting velocity of the feeding device is adjustable in dependence of a signal from the sensor device based on at least one of the counted number of detected particles or the material properties of the detected particles, wherein the sensor device comprises a first sensor part, wherein the first sensor part is a transmitter part adapted to transmit beam shaped energy, and a second sensor part, wherein the second sensor part is a receiver part to measure at least one of reflection or attenuation when a particle is passing the energy beam, wherein the sensor device is arranged to count particles to determine a total counted number of particles passing said first and second sensor part, wherein the sensor device comprises a third sensor part configured to detect an electromagnetic response of the particles passing said third sensor part, wherein the sensor device is arranged to count metal particles to determine a counted number of metal particles passing said third sensor part, wherein the sensor device comprises a detection section configured to allow to pass a sample of the first particle fraction, wherein the sensor device is configured to calculate a metal grade of the first particle fraction based on the total counted number of the detected particles passing said first and second sensor part, the counted number of metal particles passing said third sensor part, and a given average particle mass ratio between non-metal and metal particles, wherein the eddy current separation apparatus is configured to adjust the position of the splitter element substantially continuously based on the signal from the sensor device.

2. The eddy current separation apparatus according to claim 1, wherein the sensor device is arranged at a side of the splitter element facing away from the separator drum.

3. The eddy current separation apparatus according to claim 1, wherein the respective particle fractions comprise one of a ferrous metal particle fraction, a non-ferrous metal particle fraction and a non-metal particle fraction.

4. The eddy current separation apparatus according claim 1, wherein the separator drum comprises a least one of a permanent magnet or an electromagnet, any electromagnet being configured to be switched on and off during the separation process.

5. The eddy current separation apparatus according to claim 1, wherein the eddy current separation apparatus comprises a control unit operatively connected to at least one of the sensor device, the particle feeding device or the splitter element, wherein the control unit is configured to control at least one of a feeding device velocity, displacement or orientation of the splitter element with respect to the separator drum.

6. The eddy current separation apparatus according to claim 5, wherein the control unit comprises a memory to store at least one of a predetermined relation between at least a number of detected particles and the splitter element position or the feeding device velocity.

7. The eddy current separation apparatus according to claim 5, wherein the eddy current separation apparatus further comprises a device for determining a particle feed rate of the feeding device to the separator drum, wherein the control unit is operatively coupled to said device.

8. The eddy current separation apparatus according to claim 1, wherein the eddy current separation apparatus comprises a frame that slidably receives the splitter element.

9. The eddy current separation apparatus according to claim 1, wherein the eddy current separation apparatus comprises a frame that rotatably receives the splitter element.

10. The eddy current separation apparatus according to claim 1, wherein the transmitter part of the sensor device is arranged such that in use the transmitted energy travels towards a splitter element surface in a direction substantially perpendicular to said splitter element surface.

11. The eddy current separation apparatus according to claim 1, wherein the transmitter part of the sensor device is arranged such that in use the transmitted energy travels substantially parallel to a splitter element surface.

12. The eddy current separation apparatus according to claim 10, wherein the receiver part of the sensor device is arranged at a distance from the splitter element surface.

13. The eddy current separation apparatus according to claim 11, wherein the receiver part of the sensor device is arranged such that in use the transmitted energy is received from a direction substantially parallel to the splitter element surface.

14. The eddy current separation apparatus according to claim 1, wherein the sensor device is at least partly surrounded by a cover.

15. The eddy current separation apparatus according to claim 1, wherein upstream and downstream of the splitter element a respective receiving area is provided.

16. A method for separating particles from a stream of particles, wherein the method comprises:

providing an eddy current separating apparatus according to claim 1;

providing a particle stream to the separator drum of the eddy current separation apparatus;

detecting a number of particles of at least part of one of the particle fractions coming from the separator drum and counting said number of particles;

determining a number of metal particles of at least part of said particle fraction and counting said number of metal particles; and displacing the splitter element based on the particle count and on the metal particle count to adjust at least one of the distance between the splitter element and an outer circumference of the separator drum, the orientation of the splitter element with respect to the outer circumference of the separator drum or the transporting velocity of the feeding device, based on the counted number of particles.

* * * * *